US005102051A

United States Patent [19]

Smith et al.

[11] Patent Number: 5,102,051

[45] Date of Patent: Apr. 7, 1992

[54] SPRAY GUN

[75] Inventors: Rowland C. Smith, Wimborne; Anthony J. Bate, Bournemouth; David P. Whitby, Poole Dorset, all of England

[73] Assignee: ITW Limited, Windsor, England

[21] Appl. No.: 302,578

[22] Filed: Jan. 26, 1989

[30] Foreign Application Priority Data

Feb. 1, 1988 [GB] United Kingdom ..... 8802130

[51] Int. Cl.[5] ..... B05B 1/28

[52] U.S. Cl. ..... 239/297; 239/301; 239/526

[58] Field of Search ..... 239/290, 291, 296, 297, 239/300, 301, 526, 525, DIG. 14; 285/261; 403/122

[56] References Cited

U.S. PATENT DOCUMENTS

| | | | |
|---|---|---|---|
| 1,706,006 | 3/1929 | Thompson | 239/300 |
| 1,849,300 | 3/1932 | Jenkins . | |
| 2,740,670 | 4/1956 | Harder | 239/301 |
| 2,754,153 | 7/1956 | Barthod | 239/526 |
| 3,746,253 | 7/1973 | Walberg | 239/15 |
| 3,747,859 | 7/1973 | Gabel et al. | 239/418 |
| 3,796,376 | 3/1974 | Farnsteiner | 239/528 |
| 4,145,004 | 3/1979 | Krizik | 285/261 |
| 4,531,675 | 7/1985 | Muck | 239/290 |
| 4,560,109 | 12/1985 | Teruyuki et al. | 239/526 |
| 4,657,184 | 4/1987 | Weinstein | 239/296 |
| 4,767,057 | 8/1988 | Degli et al. | 239/296 |
| 4,817,872 | 4/1989 | Mattson | 239/300 |
| 4,842,203 | 6/1989 | Kuhn et al. | 239/296 |
| 4,842,308 | 6/1989 | Spotts | 285/261 |
| 4,905,905 | 3/1990 | Hufgard | 239/297 |
| 4,993,642 | 2/1991 | Hufgard | 239/290 |

FOREIGN PATENT DOCUMENTS

| | | |
|---|---|---|
| 0075018 | 3/1983 | European Pat. Off. . |
| 488046 | 6/1938 | United Kingdom . |
| 520367 | 4/1940 | United Kingdom . |
| 623269 | 5/1949 | United Kingdom . |
| 638777 | 6/1950 | United Kingdom . |
| 735983 | 8/1955 | United Kingdom . |
| 952457 | 3/1964 | United Kingdom . |
| 1118464 | 9/1965 | United Kingdom . |
| 1184900 | 3/1970 | United Kingdom . |
| 2154903 | 9/1985 | United Kingdom . |
| 2155049 | 9/1985 | United Kingdom . |

*Primary Examiner*—Andres Kashnikow
*Assistant Examiner*—Christopher G. Trainor
*Attorney, Agent, or Firm*—MacMillan, Sobanski & Todd

[57] ABSTRACT

A spray gun operable by low pressure high volume air is described. The spray gun (10) comprises an air cap (128) formed with a central spraying aperture and a fluid nozzle (70) projecting toward the spraying aperture, the profile of the nozzle is a plain frustum of a core terminating at a small front face bounding an orifice through which fluid is discharged. The arrangement being such that in operation a flow of atomizing air that emerges through a gap between the nozzle (70) and the air cap (128) attaches to the nozzle (70) and to an emergent fluid jet which assumes a conical form that is a continuation of the nozzle surface and changes to a parallel jet before it breaks up into atomized droplets.

5 Claims, 12 Drawing Sheets

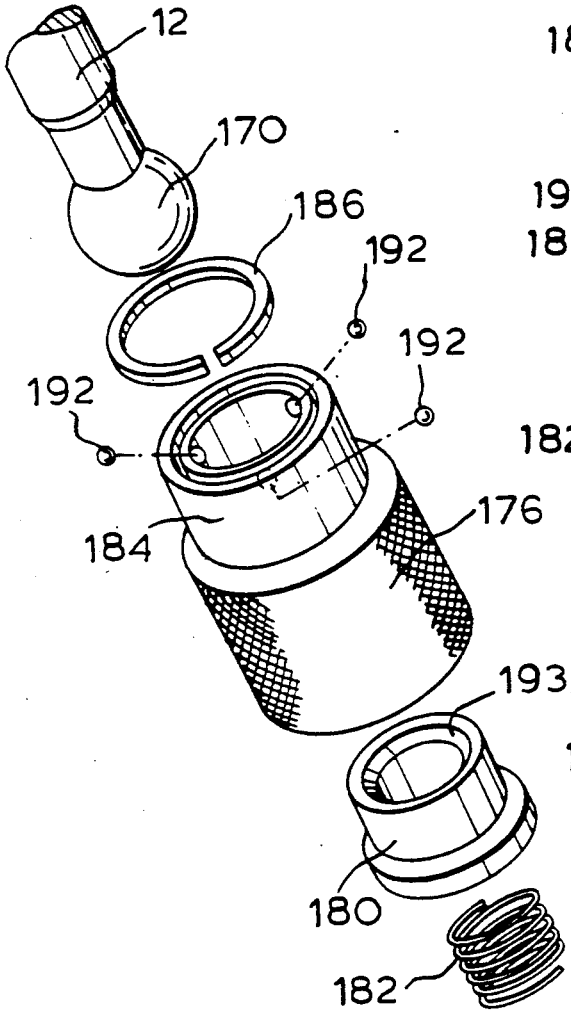
FIG.16.
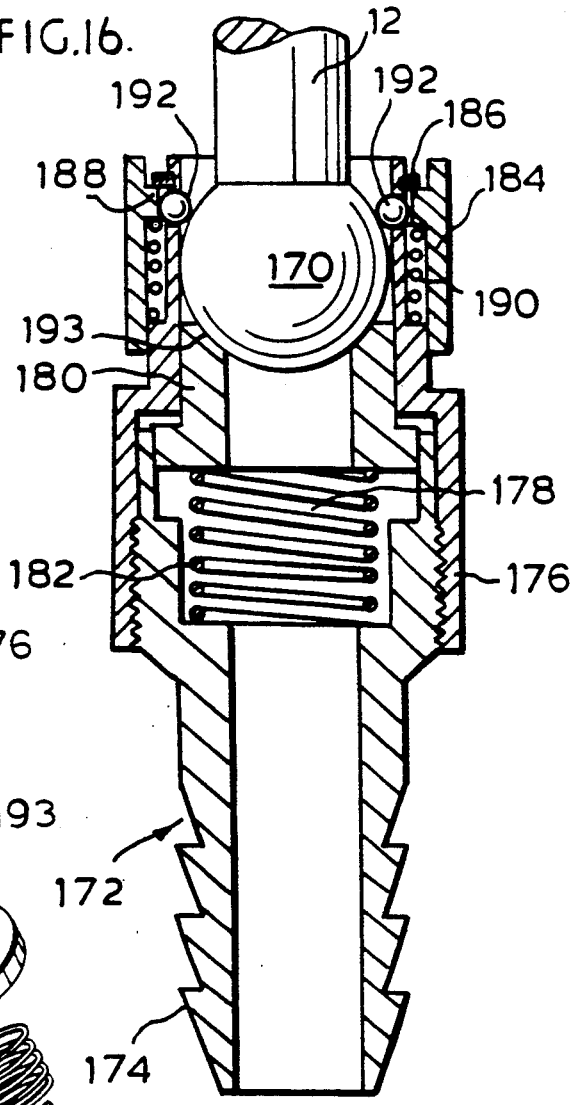
FIG.15.
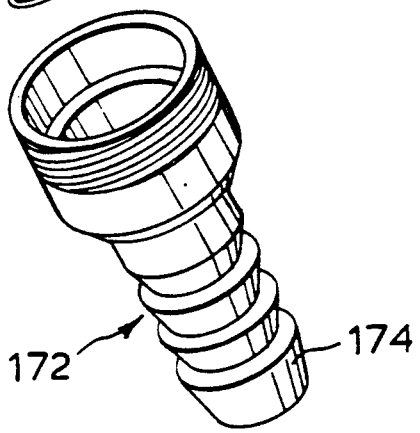

SPRAY GUN

BACKGROUND OF THE INVENTION

This invention relates to a spray gun, and more particularly to such a spray gun that is operable by high volume low pressure air as is obtainable, for example, from a turbine compressor or by step down in pressure from an airline through a control unit wherein heat may be added to the emergent air.

SUMMARY OF THE INVENTION

In one aspect the invention is based on the discovery that if such a spray gun has a fluid tip in the form of a plain cone without, for example, a step leading to a straight terminal section containing the fluid orifice, a more fine atomization of the fluid is obtained within a broader spray pattern.

Accordingly, the invention provides a spray gun operable by low pressure high volume air and having an air cap formed with a central air aperture and a fluid nozzle projecting toward the central air aperture, the profile of the nozzle being a plain frustum of a cone terminating at a small front face bounding an orifice through which fluid is discharged, wherein during operation a flow of atomizing air that emerges through the gap between the nozzle and the air cap attaches to the nozzle and to an emergent fluid jet which assumes a conical form that is a continuation of the nozzle surface and changes to a parallel jet before it breaks up into atomized droplets.

In a second aspect of the invention there is provided an improved fan control structure for a high volume low pressure spray gun. Thus the invention provides a spray gun having a body and a fluid spray nozzle and air cap at the front of the body formed with horns, wherein means at the front of the body divides air from the body into a first flow that provides atomizing air around the nozzle and a second flow that provides spreader air to the horns, wherein a fan control ring supported for rotation about an axis parallel to the gun body is moveable between a position where the control ring allows free flow of spreader air and a position where portions of the control ring obstruct the free flow of spreader air.

In a further aspect the invention provides a spray gun having a body and a handle formed as separate components, with the handle having an internal space open at each end through which extends an air supply tube formed adjacent one end with a connector formation to permit coupling thereto of an air supply and with a flange on which the handle is supported and at its other end with a connector formation which engages into the body to hold said tube and said handle to the body.

In a yet further aspect the invention provides a spray gun having a ball formation at the base of the handle for reception in a socket formation at the end of an air delivery hose so that the gun can be connected airtightly to the hose while being pivotable at the ball and socket joint.

In a modified construction the invention provides a spray gun having a body and a fluid spray nozzle and air cap at the front of the body formed with horns, including means at the front of the body to divide air from the body into a first flow that provides atomizing air around the nozzle and a second flow that provides spreader air to the horns, wherein a fan formed by the fluid spray is controlled by an air valve regulating the supply of spreader air to the horns.

Conveniently, the air valve is an axially adjustable threaded plunger which restricts the spreader air flow path.

Preferably the spray gun is connected to a pressurized fluid supply wherein the pressure is applied via a relief valve by an auxiliary air supply connected to the spray gun air passages.

In a preferred arrangement the relief valve is rotatable to restrict the air pressure acting on the fluid supply. In another aspect of the invention, the fluid supply may be at a distance and independent for its pressurization from the spray gun wherein the auxiliary air part is closed by a screw plug, the required pressurization of the fluid affected by independent means, and the fluid connection to the spray gun made by flexible hose having suitable terminal couplings.

BRIEF DESCRIPTION OF THE DRAWINGS

Embodiments of the invention will now be described, by way of example only, with reference to the accompanying drawings, in which:

FIGS. 15 and 16 are an exploded and a sectional view of a ball and socket connector that can be used between an air supply hose and an air connection of a tube extending through the handle of the gun;

DESCRIPTION OF THE PREFERRED EMBODIMENT

Figure 1:
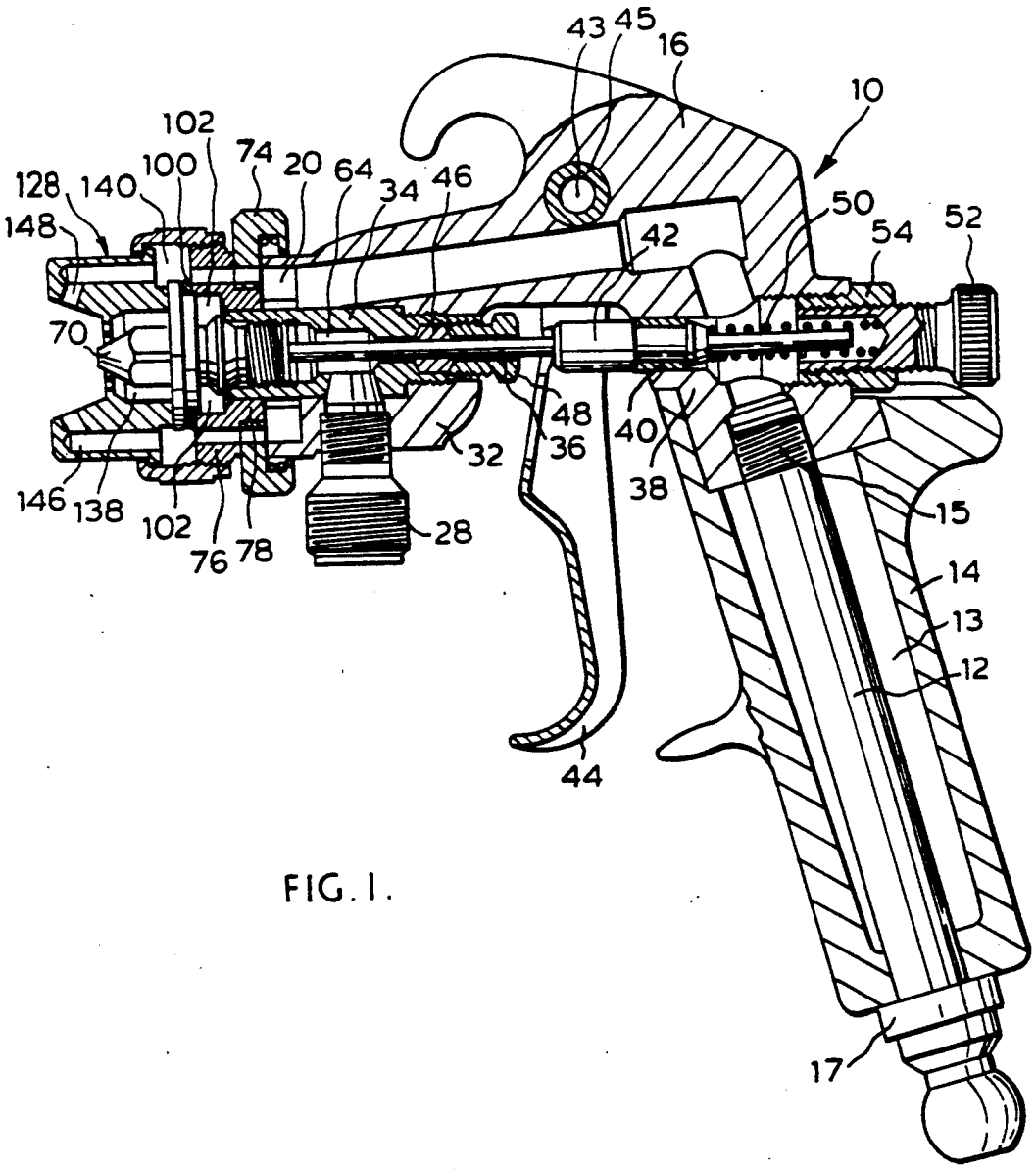
FIG. 1 is a view of a paint spray gun in vertical section.
Figure 2:
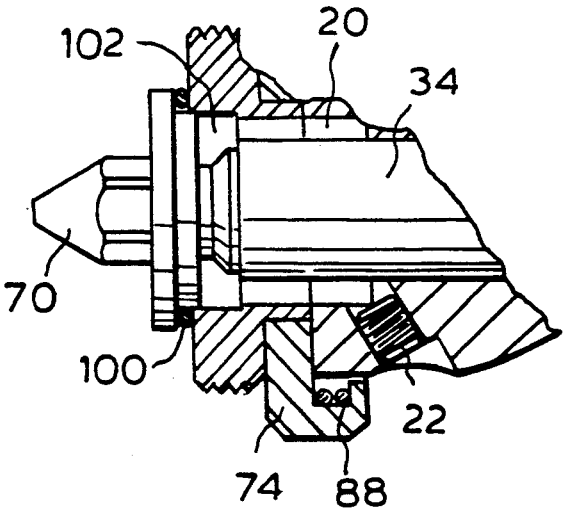
FIG. 2 is a fragmentary section of the front of the gun in a second plane but with an air cap and retaining ring removed.
Figure 3:
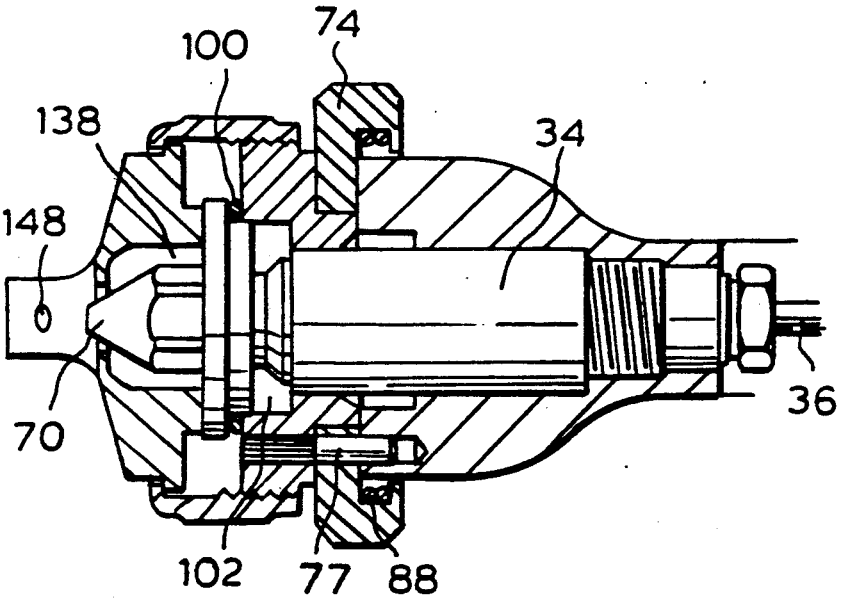
FIG. 3 is a fragmentary section of the front of the gun in a third plane.

With reference to a first embodiment of a hand-held spray gun shown in FIGS. 1 to 16, a high volume low pressure spray gun generally denoted by the reference numeral 10 is fed with air from an industrial turbine at a typical pressure of 6 psi (0.4 bar) but which could be as high as 15 psi (1.02 bar) and at a typical temperature of about 60–70 degrees C. and flow rate of about 15 cubic feet per minute. The air enters the gun 10 through a handle tube 12 that is located and adjacent its lower end in a gun handle 14 of the plastics or other non-metallic material. The tube 12 has a threaded upper end 15 that screws directly into a gun body 16. The tube 12 is flanged at 17 adjacent its lower end to support the handle 14. The handle 14 has an enlarged upper end where it joins the body, and the enlargement includes a pair of lateral ribs directed front to rear of the gun. When the gun is gripped, those ribs can distribute weight onto the thumb and forefinger making it less tiring to use the gun for extended periods. Furthermore, it may be desirable from the comfort standpoint to use a reduced gripping distance between the handle and a trigger. To facilitate hand control of the gun, it is desirable that the handle should be of adequate thickness, but less than that which makes it difficult to grip. An air space 13 exists between the tube 12 and the handle 14 to minimize heating of the handle by the air stream. In this way, the handle is maintained at a comfortable temperature during extended operation of the gun. The air stream passes through large-bore air passages 18 of the body 16 to a distribution chamber 20 at the front end of the body 16. In a version of the gun where a pressure paint cup is fitted, air bled from the chamber 20 via port 22 and a tube 24 (FIG. 4) to the paint cup 26. The air pressure in the cup 26 urges paint upwardly through a rising fluid tube to an inlet 28 to the gun body on which a threaded connector 30 of the cup 26 fits. Alternatively, the cup 26 could be pressurized from an external source such as a separate air supply. A further possibility is that the paint could be supplied from another pressurized source via a flexible hose.

The gun body 16 has a head 32 formed with a through bore into which is permanently fixed a reinforcing and corrosion resistant sleeve 34 through which a needle 36 passes. The fluid inlet 28 is screwed into the head 32 of the gun body and makes a cone to cone seal with the sleeve 34 The needle assembly 36 enters the gun body 16 at an upper handle region 38 thereof and carries a sleeve 40 of PTFE or other suitable material that makes an air-tight slideable seal to bore in the gun body. It also carries a collar 42 that provides an abutment against which a trigger 44, pivoted to the body 16 at pivot 43, acts. The pivot 43 is in an insulator bush 45 which serves to prevent heat from the hot air entering the body 16 from passing down into the trigger. The needle 36 passes into the sleeve 34 via a retaining screw 48 and a packing gland 46. It may be of stainless steel and may have a polyacetal tip. A coil spring 50 in compression in a bore of the upper handle 38 urges the needle 36 forwardly. The coil spring is supported in a fluid adjusting knob 52 that is threadedly engaged in a body bush 54 and also serves to provide a moveable abutment limiting rearward movement of the needle 36 by the trigger 34 as is conventional in the spray gun art. The body bush 54 can be abbreviated as shown, leaving the air passage 18 intersecting a portion of the bore in the upper handle around the spring 50, the sliding bush 40 providing an adequate air seal at the low air pressures used.

Figure 4:
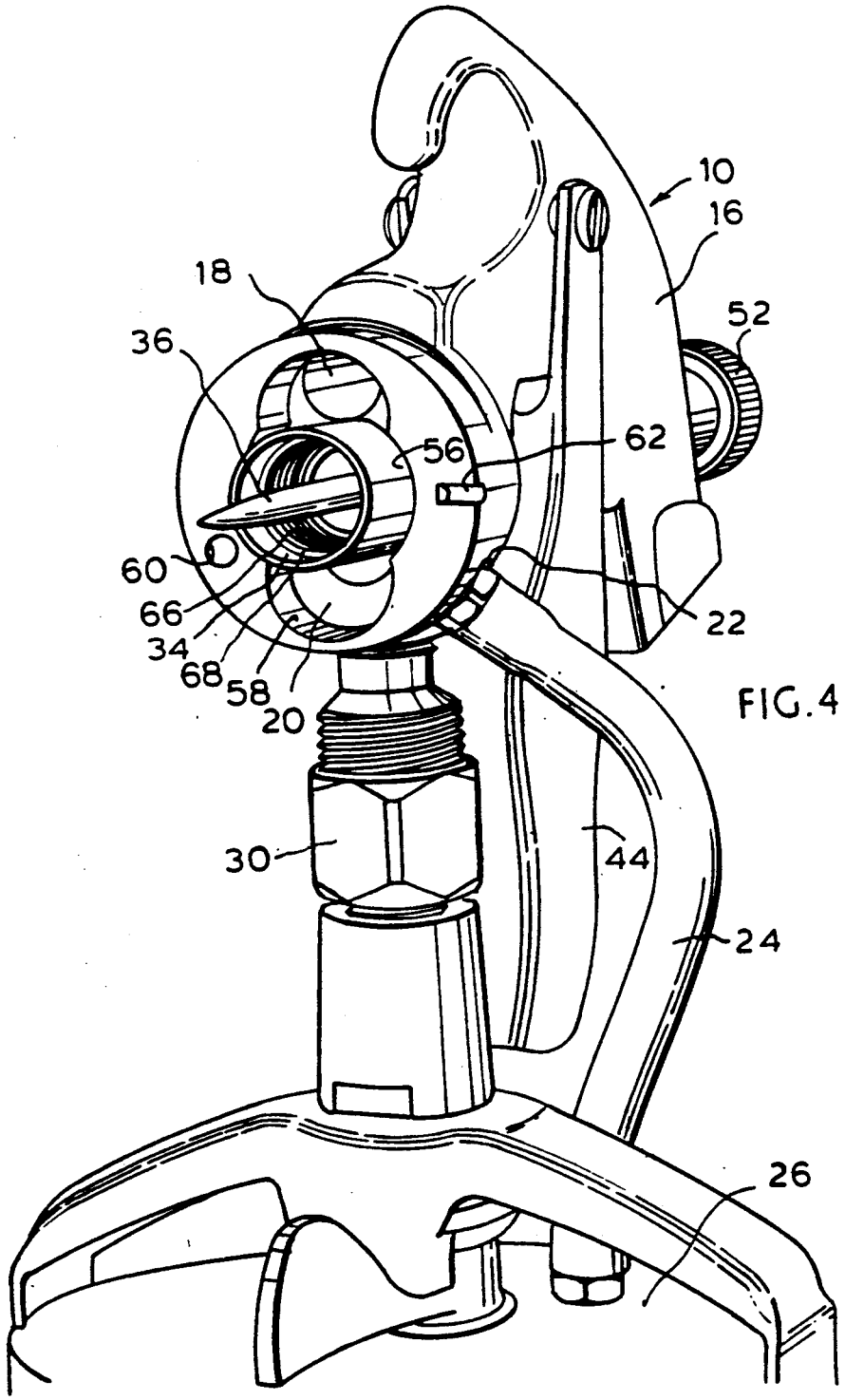
FIG. 4 is a front perspective view of a gun body with portions of a paint cup and with the front components of the gun removed.
Figure 5:
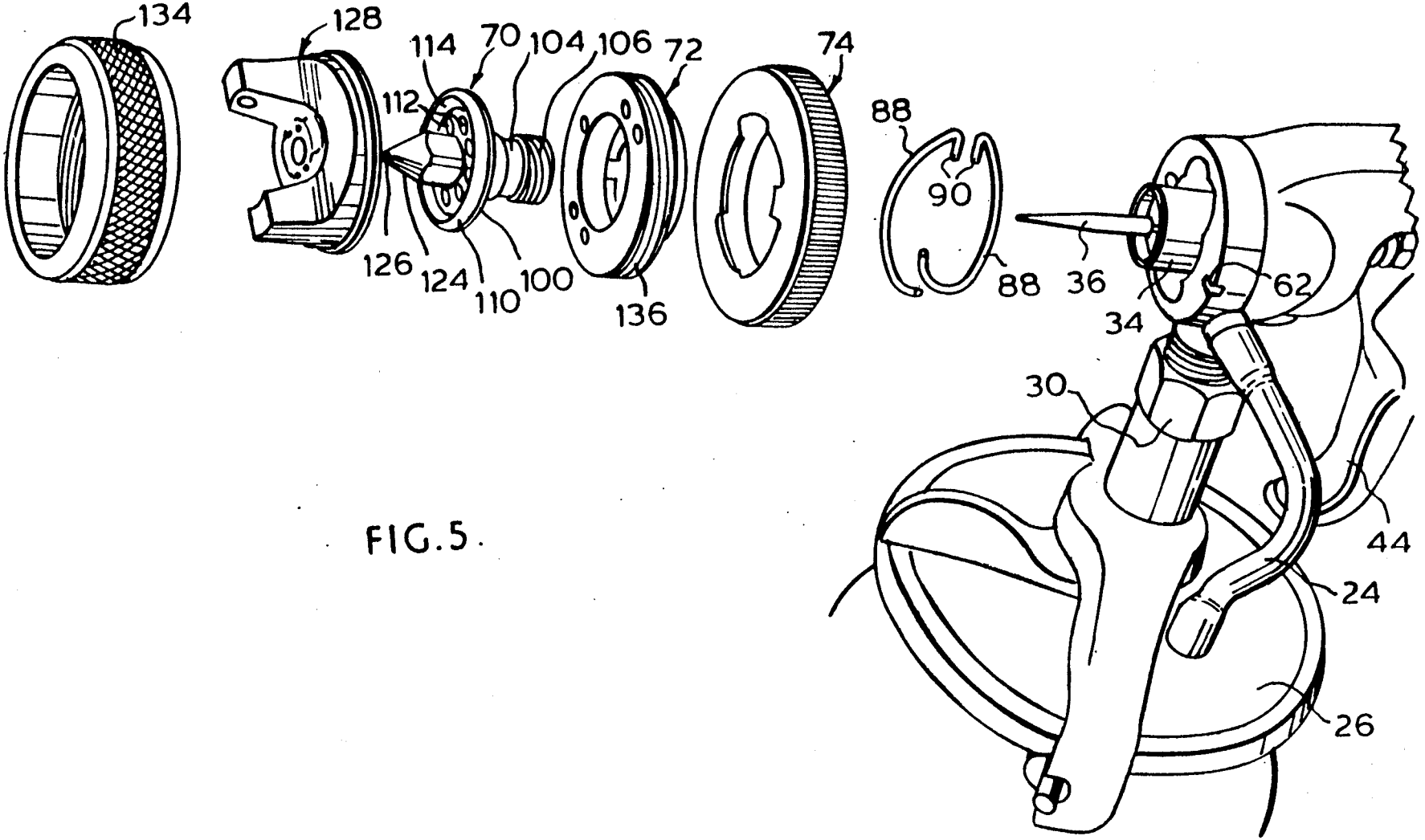
FIG. 5 is a view of the gun with the front components shown exploded.
Figure 6:
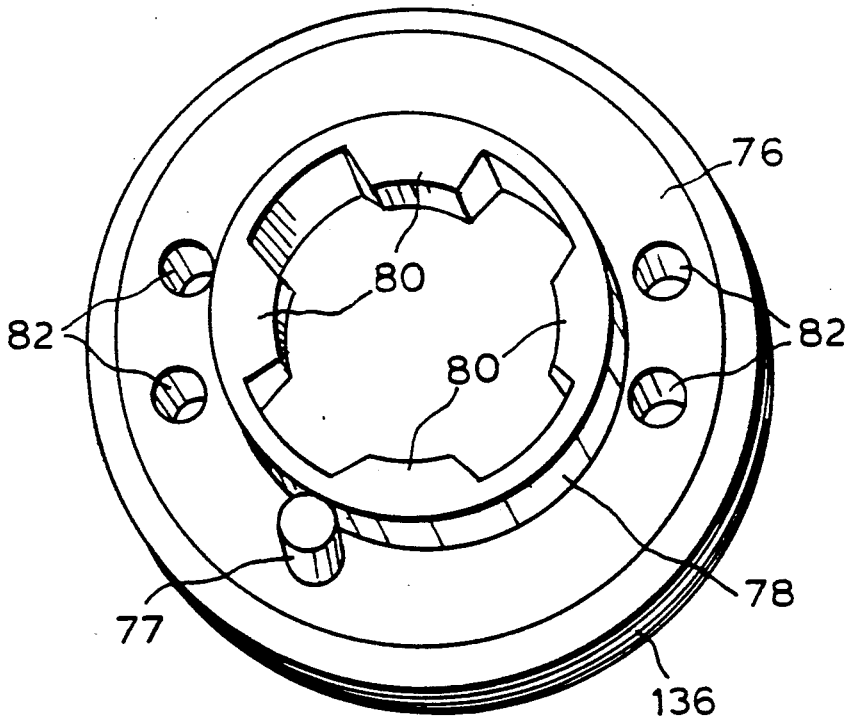
FIGS. 6 and 7 are rear and front perspective views of a baffle head forming part of the spray gun.
Figure 7:
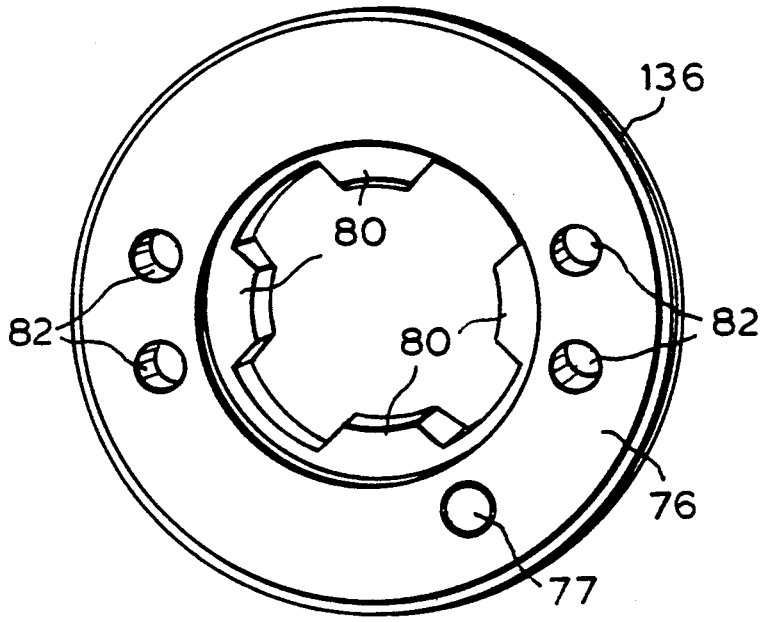

The form of the distribution chamber 20 is apparent from FIG. 4 and comprises a central zone 56 surrounding the sleeve 34 which projects forwardly of the body as shown and upper and lower lobes 58, the air passage 18 entering the chamber 20 at the upper lobe as shown. The reason for the provision of the lobes 58 is to provide a sufficient radial extent of the distribution chamber 20 to enable the air flow to be divided into atomizing and horn or spreader air streams as described below. The front face of the gun body is formed with a blind hole 60 for receiving a locating pin and with a spring-receiving slot 62. The fluid passage 64 (FIG. 1) has an enlarged forward end that is internally threaded at 66 and terminates a conical seat 68.

The flow of fluid and air is controlled by a fluid nozzle 70, baffle head 72 and fan control wheel 74 which fit one behind another on the body 16 as shown. The baffle head 72 may be machined out of bar and has an annular body 76 having on its rear face a locating pin 77 that fits into the socket 60 to prevent the baffle head 72 from rotating relative to the body 16. It also has a spigot 78 within which are formed four splines 80 and two radially opposed sets of closely spaced pairs of air holes 82. When the baffle head 72 is offered to the body 16, the splines 80 fit over the sleeve 34 to define therebetween passages for forward flow of atomizing air, and the spigot isolates the central zone 56 of the distribution chamber 20, leaving the lobes 58 extending therebeyond.

Figure 8:
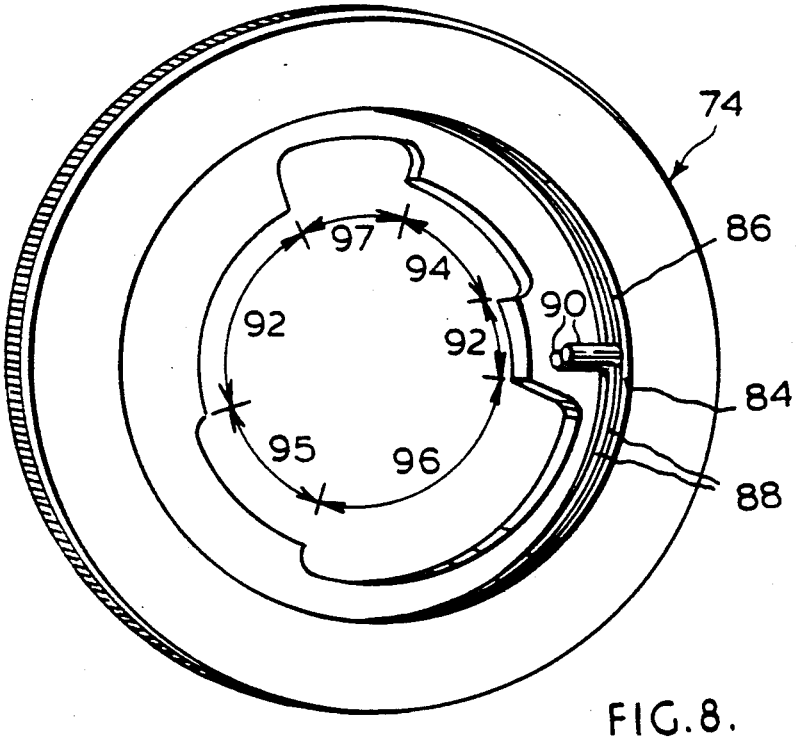
FIGS. 8 and 9 are rear and front perspective views of a fan control wheel forming part of the spray gun.
Figure 9:
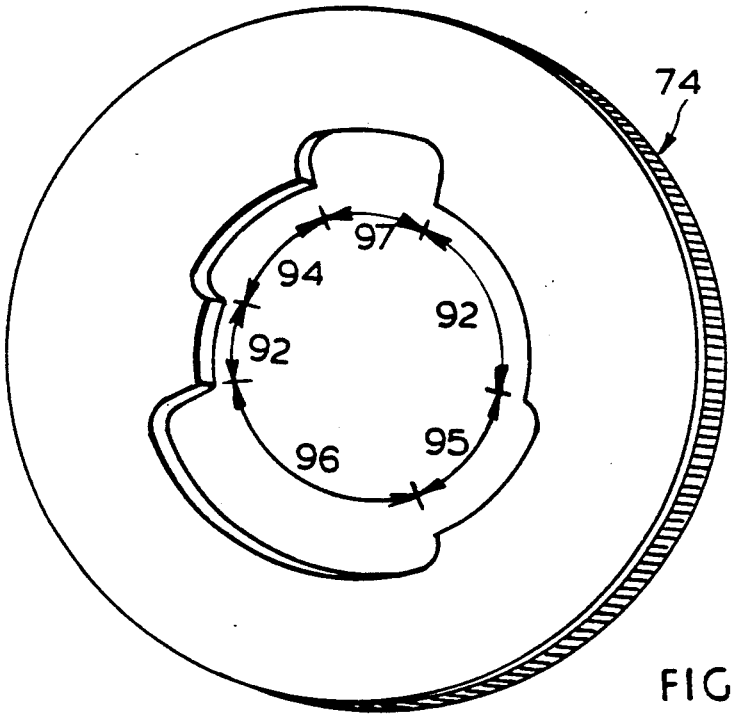

The fan control wheel 74 is annular and is formed with a socket-defining recess 84 on its rear face leading to an annular groove 86. The head region 32 of the body 16 is a close clearance fit into the socket recess 84, and the groove 86 houses a pair of oppositely facing C-springs 88 having inturned locating tongues 90 that both fit into the slot 62 at the front face of the gun body. The fan control wheel is rotatably supported on the spigot 78 by central bearing portions 92, and the pair of C-springs 88 offers an equal but slight controlled resistance to rotation in clockwise and anti-clockwise direction so that the control wheel can be set to a desired position but will not move until reset. As seen in FIGS. 8 and 9, the central bearing region 92 which is formed in separated portions, as shown leads via cam regions 94, 95 to a pair of diametrically opposed arcuate slots 96, 97, the slot 96 having a greater angular extent. When the fan control wheel 74 is in position on the baffle head 72, the pin 77 locates into the slot 96 to define a range of angular movement of the wheel 74. The holes 82 register with the lobes 58 of the distribution chamber 20 and the fan control wheel is rotatable between a first position in which the holes 82 are occluded to block off the flow of spreader air to a second position in which the holes 82 appear in the slots 96, 97 to permit the free flow of spreader air. In intermediate positions the holes 82 are gradually opened or choked off, and the cam regions 94, 95 enable the extent of flow to be more finely controlled. The front face of the baffle head 72 is formed with a seating face 98 for a fluid nozzle gasket 100, there being an atomizing air distribution chamber 102 defined within the baffle head forwardly of the splines 80.

Figure 10:
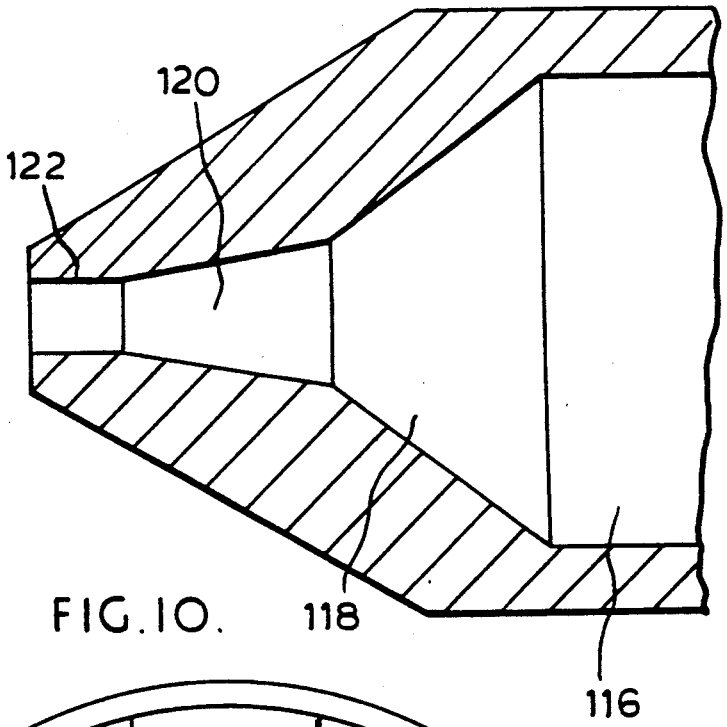
FIG. 10 is a fragmentary longitudinal section of the spraying tip.
Figure 11:
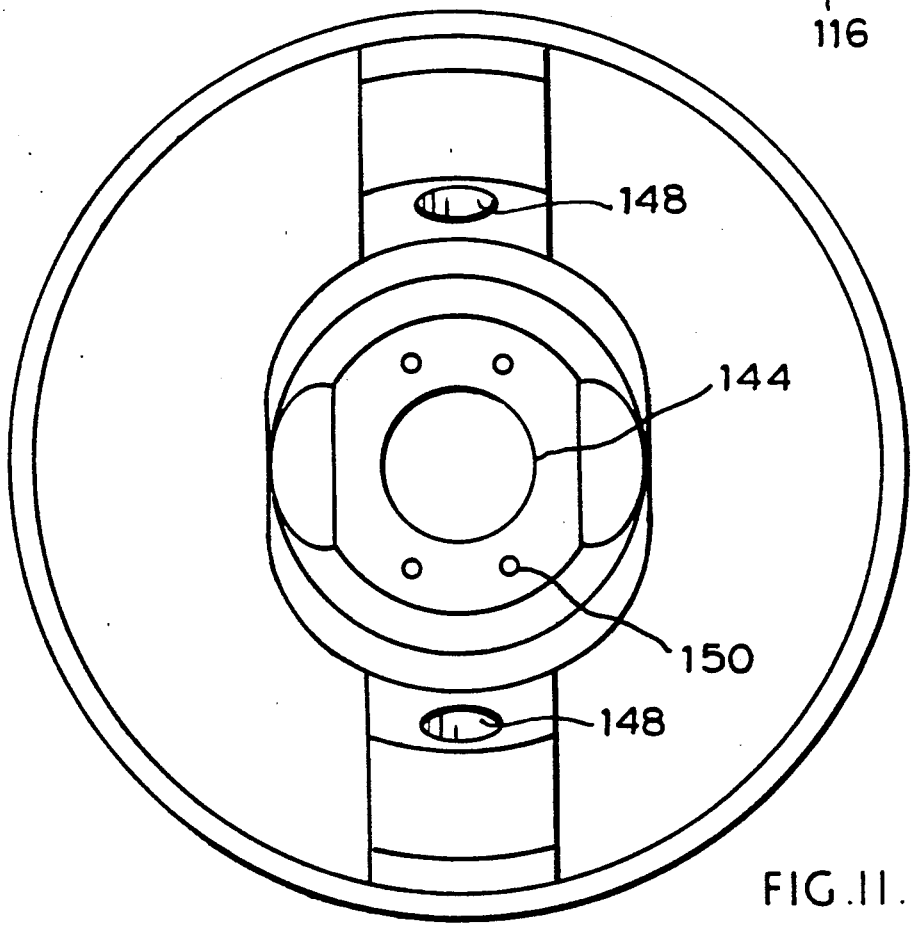
FIGS. 11 to 13 are a front, a plan and a sectional view of an air cap for the gun.
Figure 12:
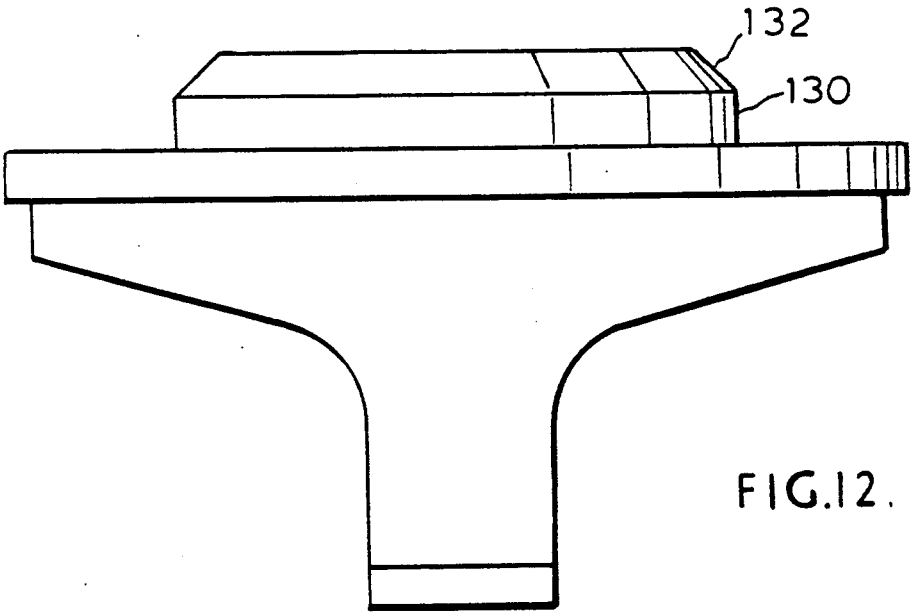
Figure 13:
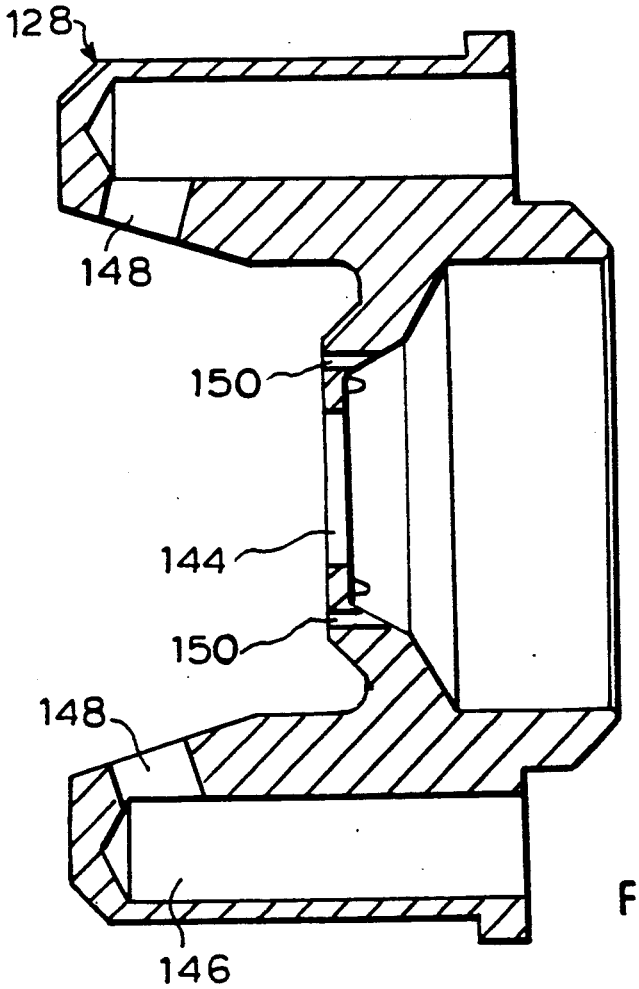

The fan control wheel 74 and the baffle head 72 are held to the body 16 by the fluid nozzle 70 which has a rear sleeve region 104 formed with a threaded back portion 106 that screws into the threaded region 66 of the sleeve 34 until a conical ring 108 seats onto the conical seat 68. The gasket 100 fits behind a flange 110 of the nozzle, and a multiplicity of apertures 112 for forward flow of atomizing air are formed in the flange 110. The forward face of the flange 110 is formed with a recess bounded by a conical seat 114. The internal shape of the front end of the fluid tip, where it seats the needle 36 is shown in FIG. 10. A parallel bore region 116 leads to a transition region 118 of about 75 degrees included angle leading to a seat 120 of about 20 degrees included angle terminating in a relatively small straight fluid orifice 122. The transition region 118 is more gradual in order to facilitate fluid flow compared with conventional spray tips. The nozzle 70 has a front cone 124 that joins the fluid orifice 122 at a front face 126.

An air cap 128 fits over the fluid nozzle 70 with a boss 130 of spherical external profile at 132 sealing against the seat 114 of the fluid tip and is retained by a retaining ring 134 that screws onto the baffle head 72 which is externally threaded at 136. The seat 132 isolates a chamber 138 for atomizing air from a chamber 140 for spreader air. The atomizing air escapes from chamber 138 through an annulus 142 defined between the front cone 124 and a center hole 144 of the air cap. The spreader air flows from chamber 140 through feeder holes 146 to horn holes 148. Atomizing air also escapes through a number of cleaner holes 150 in the air cap 128.

Figure 14:
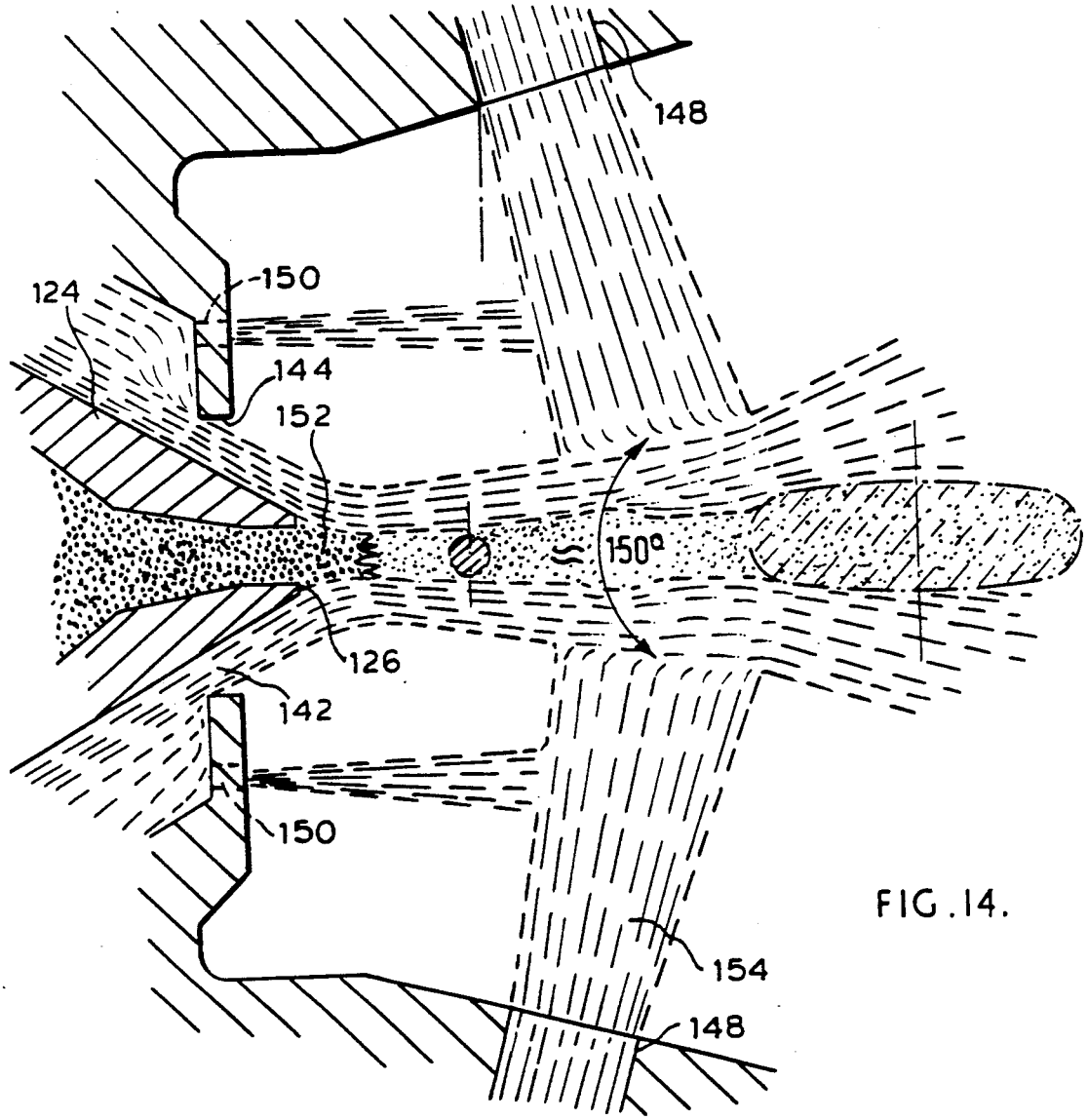
FIG. 14 is a diagrammatic view of part of the fluid nozzle and part of the air cap illustrating the air and fluid flow while the gun is operating.

As best seen in FIG. 14, the nozzle front cone 124 protrudes slightly beyond the front face of the air cap, and the face 126 is small. The flow of atomizing air attaches to the front cone 124 and to the emergent fluid jet 152 which covers the face 126 and assumes a conical form that is a continuation of the surface 124, changing to a parallel jet before it breaks up into atomized droplets. A slightly diverging column of atomized paint is struck by opposed jets of spreader air 154 at a shallow angle, typically an included angle of about 150 degrees, bringing the point where the spreader air impinges on the jacket of the atomizing air nearer the surface 126. It is believed that it is possible to use such a shallow angle without splitting the spray pattern because the air from jets 154 is a high volume but low pressure flow and the energy in the air dissipates relatively rapidly with distance. It has been found possible with a gun having a spraying tip as described herein and with the 150 degrees horn angle to produce a spray pattern having an even paint distribution throughout its width and a pattern width as great as 14–16 inclines at a spraying distance of 8 inches. Because of the shallow angle of the horn air 154, there was a tendency for paint to deposit on the front face of the air cap 128. In a previous design of high volume low pressure spray gun air cap, cleaning holes have been omitted, but the result has been that the air cap becomes very dirty. We have been able to provide cleaning air without interfering with the spray pattern homogeneity by providing cleaning holes 150 that occur in pairs with the holes in each pair offset to opposite sides of a line joining the horn holes 148. In this way, the emergent horn air 154 does not have to penetrate the cleaning jets from holes 150, and its energy is wholly available for forming the paint pattern. We have carried out tests with the offset cleaning holes and both with and without an extra pair of cleaning holes on the center line. It has been found in the test that deletion of holes on the center line contributes markedly to the evenness of the deposited paint pattern.

A further problem solved by the spray gun of the invention is the provision of a satisfactory connection between the handle tube 12 and an air supply hose leading from a compressor or other air source to the gun. With the high volume low pressure air flow that is employed, the hose has to be of relatively large diameter, and if it had to be rigidly connected to the gun body, an operator would encounter relatively high forces from bending the hose during the operation of paint spraying which would make the gun hard to use. The problem is solved, according to a further aspect of the invention, by the provision of a ball and socket joint between the hose and an air delivery tube in the gun handle. In FIGS. 15 and 16, the handle tube 12 terminates at a ball formation 170. A hose connector stem 172 has a serrated lower region 174 that is a push fit into a plastics or rubber air hose. A tubular connector body 176 is screwed onto the stem 172 and defines with it a cavity 178 in which is held captive a flanged seat member 180 that is biased upwardly by coil spring 182 in compression. A sleeve 184 fits over the forward end of the body 176 on which it is held captive by a retaining ring 186 which cooperates with a circumferential rib 188 on the inner surface of the sleeve 184. A coil spring 190 biases the sleeve 184 forwardly into a position abutting the ring 186. The body 176 is formed towards its forward end with at least three circumferentially spaced apertures through which latching balls 192 can protrude, the balls being held captive between the body 176 and the sleeve 184. When the sleeve 184 is forward, the rib 188 registers with the balls 192 to prevent them retracting, but when the sleeve 184 is pulled back the rib 188 is clear of the balls 192 which are free to retract. The action of the spring 190 is to provide a normally locked condition of the balls 192.

To connect the hose to the handle, the sleeve 184 is pulled back and the ball 170 of the handle tube 12 is inserted into the body 176, after which the sleeve 184 is released to latch the balls 192 in their projecting position preventing the ball 170 from being withdrawn. The seat member 180 has a spherical face 193 that is urged by spring 182 against the ball 170 to make an airtight seal therewith. With this arrangement the gun and hose are releaseably but securely connected together, but the ball and socket joint allows free pivoting movement within a range of angular travel that is sufficient for most spraying purposes.

Figure 17:
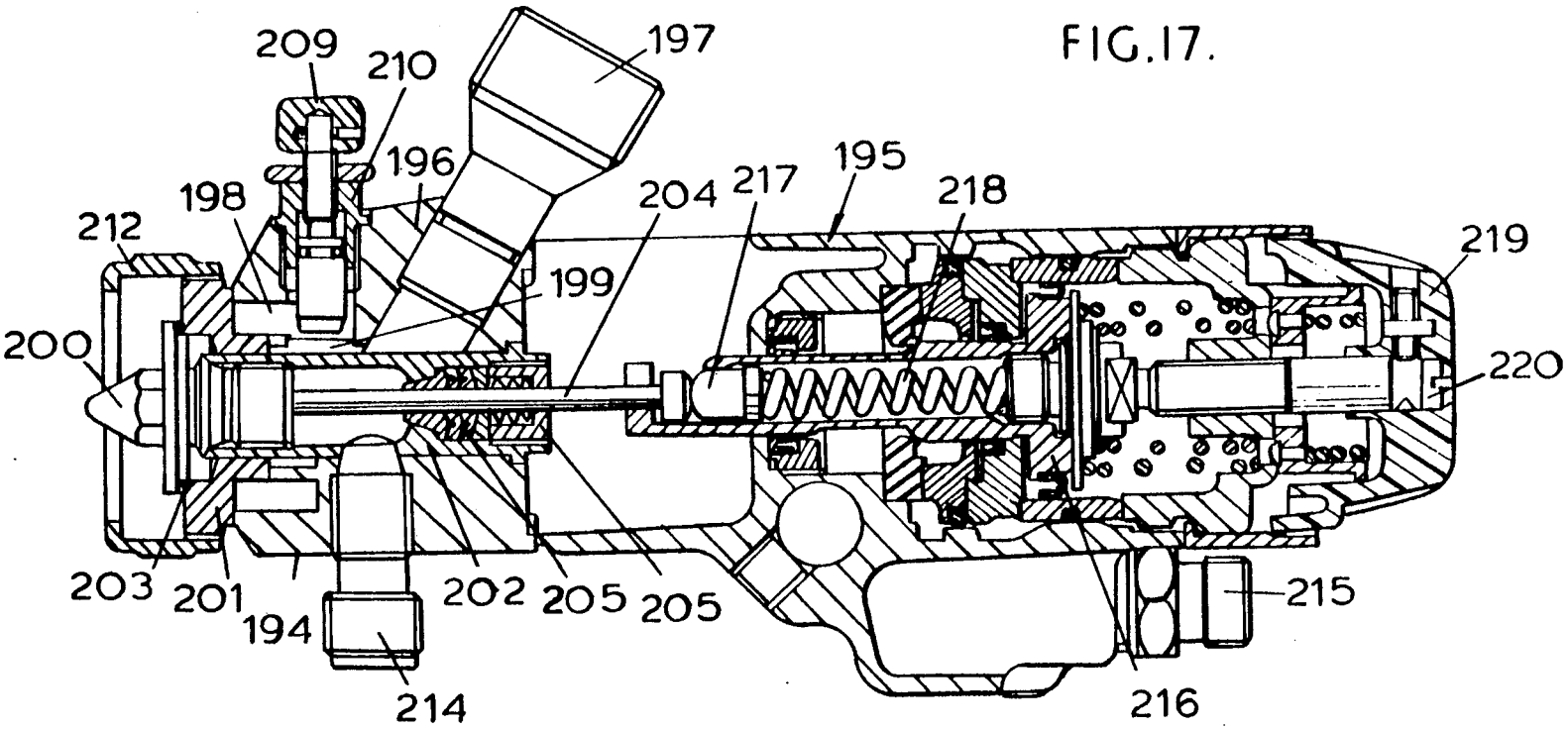
FIG. 17 is a vertical section of an automatic spray gun.
Figure 18:
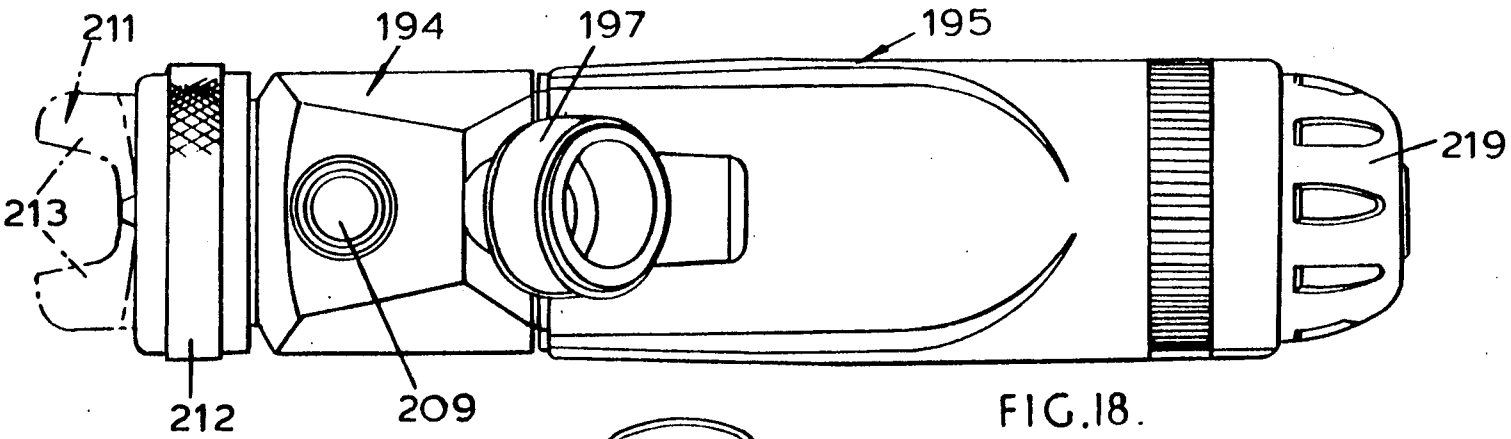
FIG. 18 is a plan view of the automatic spray gun shown in FIG. 17.
Figure 19:
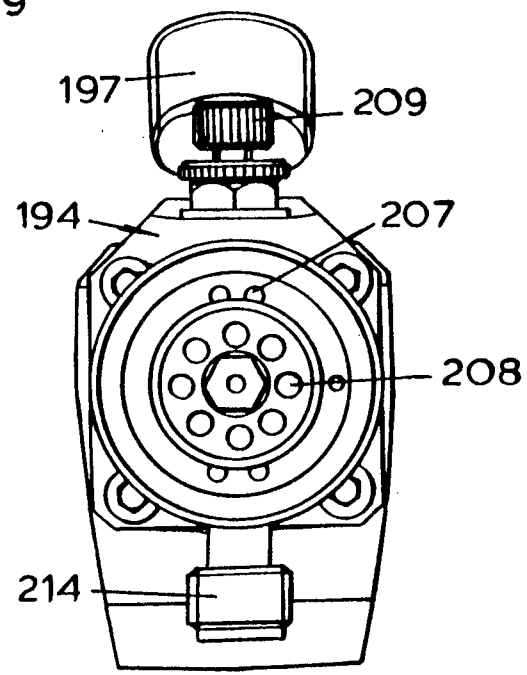
FIG. 19 is a front elevational view of the automatic spray gun shown in FIGS. 17 and 18.

A modification of the spray gun, according to the invention, is shown in FIGS. 17 to 19. This embodiment of the spray gun is automatically operated and can be mounted, for example, in a paint spray booth or attached to a programmable robot.

The automatic spray gun comprises a spray head, generally indicated at 194 bolted to a spring-loaded piston actuation assembly 195. This assembly is shown in derail in FIG. 17 and is of known construction, for example, and shown in British Patent No. 2061768.

A body 196 of the spray head 194 includes a threaded air inlet 197 which is supplied with air from an air turbine compressor or by step down in pressure from an airline through a control unit wherein heat may be added to the emergent air which is typically at a pressure of between 5 and 10 psi or up to a maximum of 15 psi. This air flows into annular chambers 198 and 199 formed by a cone shaped fluid tip 200 with a surrounding baffle head 201. The fluid tip is screwed into a sleeve 202 located in the body and is sealed to the baffle head by a gasket 203. Passing through the sleeve is a needle valve 204 which is sealed by spring loaded self-adjusting packing 205 held in the sleeve by a retaining screw 206.

Pressurized air from the air inlet 197 flows into the two annular chambers and exits from two series of holes 207 and 208, respectively. This flow of air to the outer annular chamber 198, is regulated by an air valve 209 which can be screwed in or out of its housing 210 to restrict the flow of air in the outer chamber 198.

The front end of the spray-head carries an air cap 211 shown in chain-dotted line, in FIG. 19, screwed to the spray-head by a retaining ring 212. This cap has two horns 213 having air passages connecting with the pressurized air supply via the outer chamber 198.

The fluid to be sprayed is supplied to the spray gun at the inlet 214 connected with a container (not shown) for the fluid. This supply is typically made by flexible hose connected to a pressurized fluid supply and conveniently includes a relief valve of conventional type to prevent build-up of air in the fluid container.

In operation the air valve 209 is screwed in or out of its housing 210 until the required setting of the spreader air is obtained. Air is supplied at air inlet 215 to act on piston 216. Located within piston 216 is an auxiliary piston 217 biased by a spring 218 towards the rear end of the needle valve 204 metering the supply of the fluid to be sprayed, to the fluid tip.

Adjustment of the pistons 216 can be made by means of a ratchet stop mechanism 219 secured to the rear of the spray gun by screw 220.

This embodiment operates to regulate the flow of spreader air to the horns of the air cap to control the shape of the fan of fluid being sprayed as described with reference to the first embodiment of FIGS. 1 to 16.

It will be appreciated that modifications and additions may be made to the embodiments described above without departing from the invention, the scope of which is defined in the appended claims. For example, the gun described above has a continuously operating discharge of atomizing and spreader air through the air cap that takes place without restriction. But if this feature is considered undesirable for a particular purpose, an air valve operated by the trigger may be built into the gun so that air flows only when the trigger has been operated. A regulating valve for the air may be built into the gun itself or into the hose connector. The hose connector may be provided with an automatic shut-off which cuts off the flow of air when the gun is removed from the hose.

In another modified construction of the hand-held spray fun, the ball and socket joint connecting the spray gun handle with an air supply hose is connected to a further universal connection, i.e. another ball and socket joint, to increase the pivot angle of the hose relative to the handle through an acute angle in excess of 25°.

We claim:

1. A paint spray gun operable by low pressure high volume air and having an air cap formed with a central spraying aperture and a fluid nozzle, said nozzle having an end projecting through said spraying aperture, said nozzle end having a surface profile of a plain frustum of a cone terminating at a small front face bounding an orifice through which fluid is discharged, said air cap spraying aperture directing a flow of such high volume low pressure air forwardly and inwardly to attach to the conical nozzle surface and which assumes a conical form that is a continuation of the conical nozzle surface, such air flow changing to a generally parallel jet attached to a fluid jet emerging from said orifice before such fluid jet breaks up into atomized droplets, said air cap including two horns having spreader air orifices for directing high volume low pressure jets of spreader air from opposite sides at an included angle of about 150 degrees onto a slightly diverging column of atomized fluid emerging from said nozzle, such spreader air jets impinging on a jacket of atomizing air surrounding the fluid column to provide an even wide spray pattern, said air cap defining a plurality of cleaning air orifices for discharging jets of cleaning air parallel to and spaced from the emerging fluid jet, said cleaning air orifices being offset from a plane passing through the spreader air orifices and the nozzle orifice whereby jets of spreader air do not impinge on jets of cleaning air.

2. A spray gun operable by low pressure high volume air and having an air cap formed with a central spraying aperture and a fluid nozzle, said nozzle having an end projecting through said spraying aperture, said nozzle end having a surface profile of a plain frustum of a cone terminating at a small front face bounding an orifice through which fluid is discharged, said air cap spraying aperture directing a flow of such high volume low pressure air forwardly and inwardly to attach to the conical nozzle surface and which assumes a conical form that is a continuation of the conical nozzle surface, such air flow changing to a generally parallel jet attached to a fluid jet emerging from said orifice before such fluid jet breaks up into atomized droplets, said air cap including two horns having spreader air orifices for directing high volume low pressure jets of spreader air from opposite sides at an included angle of about 150 degrees onto a slightly diverging column of atomized fluid emerging from said nozzle, such spreader air jets impinging on a jacket of atomizing air surrounding the fluid column to provide an even wide spray pattern, said air cap defining a plurality of cleaning air orifices for discharging jets of cleaning air parallel to and spaced from the emerging fluid jet, said cleaning air orifices being offset from a plane passing through the spreader air orifices and the nozzle orifice whereby jets of spreader air do not impinge on jets of cleaning air, and wherein said cleaning air orifices occur on the air cap in pairs with the orifices in each pair offset to opposite sides of the plane passing through such spreader air orifices and the nozzle orifice.

3. A spray gun having a body having an axis, and a nozzle having a fluid orifice for discharging a fluid jet and an air cap attached to a front of said body, said air cap defining an annular orifice about said fluid nozzle for discharging atomization air and including a pair of horns each having an orifice for discharging spreader air, means for delivering a relatively high volume flow of low pressure air to said spray gun, a baffle positioned between said barrel and said air cap, said baffle cooperating with said nozzle and said air cap to divide such delivered air between said atomization air orifice and said spreader air orifices, a control ring positioned between said baffle and said body for rotation about an axis parallel to such body axis, said control ring having a first position wherein the flow of such delivered air through said baffle to said atomization air and spreader air orifices is unimpeded and a second position wherein said control ring obstructs the flow of such delivered air through said baffle to said spreader air orifices, wherein said nozzle includes a threaded end attached to said body to retain said baffle and said control ring on said body, wherein said body has a sleeve containing a fluid passage, said threaded nozzle end threadably engaging said sleeve, said sleeve projecting from a front face of said body, said front face having a recess defining an air distribution chamber having a control zone surrounding said sleeve and at least one lobe of greater radial extent, an internal air passage in said body leading from said air delivery means to said distribution chamber, said baffle having an annular body with an annular spigot formed on its rear face, said annular body having a greater diameter than said spigot and having at least one air hole formed therein, said air cap having passages connecting said at least one baffle air hole with said air horn orifices, means for preventing rotation of said baffle relative to said body, said spigot having internal longitudinally directed splines fitting over said sleeve to define therebetween passages for the forward flow of atomization air, said control ring rotation about said spigot and having internal splines forming passages connecting said at least one lobe with said at least one baffle air hole when control ring is in said first position and for obstructing the flow of air from said at least one lobe to said at least one baffle air hole when said control ring is in said second position.

4. A spray gun according to claim 3, wherein said control ring is formed with a socket-defining recess on its rear face leading to an annular groove, said gun body having a head region fitting into said socket recess, at least one spring means located in said groove, said spring means engaging said control ring and said body to provide a controlled resistance to rotation of said control ring whereby said control ring will move only when manually reset.

5. A spray gun according to claim 4, wherein a gasket is positioned between a front face of said baffle and a flange on said nozzle, and wherein an atomization air distribution chamber is defined within said baffle forward of said splines.

* * * * *